US006892827B2

(12) United States Patent
Toyama et al.

(10) Patent No.: US 6,892,827 B2
(45) Date of Patent: May 17, 2005

(54) ELECTRICALLY OPERATED VIBRATING DRILL/DRIVER

(75) Inventors: Kazuto Toyama, Hikone (JP); Masao Yamamoto, Shiga (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/493,310

(22) PCT Filed: Aug. 27, 2003

(86) PCT No.: PCT/JP03/10831

§ 371 (c)(1),
(2), (4) Date: May 3, 2004

(87) PCT Pub. No.: WO2004/020156

PCT Pub. Date: Mar. 11, 2004

(65) Prior Publication Data

US 2004/0245005 A1 Dec. 9, 2004

(30) Foreign Application Priority Data

Aug. 27, 2002 (JP) ..... 2002-246719
Aug. 27, 2002 (JP) ..... 2002-247820

(51) Int. Cl.[7] ..... B25F 5/00
(52) U.S. Cl. ..... 173/48; 173/178; 173/216
(58) Field of Search ..... 173/48, 47, 104, 173/109, 216, 176

(56) References Cited

U.S. PATENT DOCUMENTS 5,451,127 A * 9/1995 Chung ..... 408/20
5,458,206 A * 10/1995 Bourner et al. ..... 173/178
5,704,433 A * 1/1998 Bourner et al. ..... 173/48
6,142,242 A * 11/2000 Okumura et al. ..... 173/48
6,152,242 A * 11/2000 Chung ..... 173/48
6,196,076 B1 * 3/2001 Chung ..... 74/22 A
6,202,759 B1 * 3/2001 Chen ..... 173/48
6,230,819 B1 * 5/2001 Chen ..... 173/48
6,688,406 B1 * 2/2004 Wu et al. ..... 173/48
6,691,796 B1 * 2/2004 Wu ..... 173/48

FOREIGN PATENT DOCUMENTS

DE 4038502 6/1992
EP 0706861 4/1996

* cited by examiner

*Primary Examiner*—Scott A. Smith
(74) *Attorney, Agent, or Firm*—Greenblum & Bernstein, P.L.C.

(57) ABSTRACT

A vibrating drill/driver includes a motor for driving a spindle about the longitudinal axis thereof, a switching handle supported for rotation about a longitudinal axis thereof, a clutch mechanism for varying a working torque in dependence on rotation of the switching handle, a switching ring having a recess and capable of rotating together with the switching handle, and a switching plate having a tip for engagement in the recess. A vibrating cam mechanism is provided to be operable to undergo a slidable engagement to provide a vibration for the spindle in an axial direction thereof when the tip of the switching plate is engaged in the recess of the switching ring. With the above-described construction, the rotation of the switching handle in one direction causes the vibrating drill/driver to be set in one of a clutch mode, a vibrating mode, and a drilling mode in this order.

3 Claims, 12 Drawing Sheets

ELECTRICALLY OPERATED VIBRATING DRILL/DRIVER

TECHNICAL FIELD OF THE INVENTION

The present invention relates to a hand-held vibrating drill/driver capable of being operated under one of a plurality of operating modes, i.e., a clutch mode, a drilling mode and a vibrating mode one at a time.

DESCRIPTION OF THE RELATED ART

A vibrating drill/driver is an electric combination tool (i.e., an electrically operated combination drill and driver) that can be used one at a time as a power screwdriver with a driver bit attached to the chuck, and as a power drill with a drilling bit attached to the chuck for boring holes by a rotating abrasion. As a variant of this electric combination tool, there is known a vibrating drill/driver having a switching handle with which the tool can be set in one of a clutch mode under which the working torque can be adjusted, a drilling mode and a vibrating mode. A number of the vibrating drill/drivers have hitherto been proposed and are constructed to provide a varying working torque in multistages in dependence on the rotation of the switching handle.

In the traditional vibrating drill/driver constructed to selectively operate under the clutch mode, the drilling mode and the vibrating mode in this order, unexpected external shock in working in the drilling mode makes the switching handle rotate and causes to work a clutch mechanism.

With this clutch mechanism, an output shaft carrying a tool piece such as a bit can be driven when the load imposed on such output shaft is small, but in the event that the load acting on the output shaft exceeds a predetermined clutch torque, the clutch mechanism prevents the output shaft from being driven. This clutch mechanism is attached to a ring gear 18 that forms one of rotatable elements of a planetary gear mechanism and takes the following structure. Referring to FIGS. 14A and 14B, the ring gear 18 has an end face defining a sliding surface 18*b* along which an engaging body 33 slides. This sliding surface 18*b* is formed with a plurality of circumferentially equidistantly spaced angled projecting portions 71 over which the engaging body 33 can ride in sliding contact therewith. A portion of a gear box 4 confronting that end face of the ring gear 18 is formed with throughholes extending at right angles to that end face of the ring gear 18. Respective pins 33*a* forming respective parts of the engaging body. 33 extend axially movably through those throughholes and are normally biased by associated clutch springs towards the sliding surface 18*b* of the ring gear 18. So long as the load torque acting on the output shaft is small, respective tips of the pins are engaged to the projecting portions 71 by the action of the clutch springs to inhibit the ring gear 18 from rotating with a driving power consequently transmitted to the output shaft. However, in the event that the load torque on the output shaft increases to a value exceeding the predetermined clutch torque, the pins 33*a* move backward against the clutch springs and ride over the projecting portions 71 onto the sliding surface 18*b*, accompanied by rotation of the ring gear 18 to hence interrupt transmission of the driving power to the output shaft. As discussed above, the clutch mechanism is so designed as to work when the load torque acting on the output shaft exceeds the predetermined clutch torque. Considering, however, that the clutch torque operable in this way varies depending on the biasing force utilized of the clutch springs to urge the pins 33*a* and the spring load of each of the clutch springs can be adjusted as desired in dependence on the rotation of the switching handle.

On the other hand, the vibrating drill/driver has recently come to be assembled lightweight and compact in structure with its power output increased and, as a result thereof, the clutch torque has increased. To meet with the increased clutch torque, attempts have been made to increase the load of the clutch springs and/or to decrease the angle of the angled projecting portions 71 of the ring gear 18. However, increase of the load of the clutch springs has been found resulting in reduction in cycling lifetime of the clutch springs and accelerated frictional wear of the projecting portions 71 of the ring gear 18, the sliding surface 18*b* of the ring gear 18 and the pins 33*a*, which in turn brings about reduction in lifetime of the clutch mechanism.

In view of the foregoing, once the clutch mechanism is operated, the lifetime of thereof decreases. In addition, in the event such an operation occurs against the will of the user of the vibrating drill/driver, the stable drilling work can no longer be performed smoothly.

The present invention has been developed to overcome the above-described disadvantages and has an objective to provide an vibrating drill/driver enabling a drilling work to be performed surely without the clutch mechanism being unexpectedly activated during the drilling mode.

DISCLOSURE OF THE INVENTION

In accomplishing the above and other objectives, the present invention provides a vibrating drill/driver including a tool housing, a spindle disposed within the tool housing movable in an axial direction thereof and also rotatable about a longitudinal axis thereof, a motor disposed within the tool housing for driving the spindle about the longitudinal axis thereof, a switching handle supported by the tool housing for rotation about a longitudinal axis thereof, and a clutch mechanism interposed between the motor and the spindle for adjustably varying a working torque in dependence on rotation of the switching handle. The vibrating drill/driver also includes a switching ring having a recessed portion defined therein and capable of rotating together with the switching handle, and a switching plate having a tip for engagement in the recessed portion. The vibrating drill/driver further includes a vibrating cam mechanism operable to undergo a slidable engagement to provide a vibration for repeatedly driving the spindle in an axial direction thereof when the tip of the switching plate is engaged in the recessed portion of the switching ring. With the above-described construction, the rotation of the switching handle in one direction causes the vibrating drill/driver to be set in one of a clutch mode in which a working torque can be varied, a vibrating mode in which the spindle is provided with a vibration in an axial direction thereof, and a drilling mode in which a working torque from the motor is directly transmitted to the spindle in this order. Therefore, if the switching handle unexpectedly rotate under the influence of an external force acting on the vibrating drill/driver during the operation thereof under the drilling mode, the vibrating drill/driver assumes the vibrating mode since at that time the tips of the switching plate are engaged in the recessed portions of the switching ring, and will not thus be switched over to the clutch mode.

Preferably, the switching ring has a projecting portion formed therewith between the recessed portion and a place where the tip of the switching plate engages in the recessed portion during the drilling mode. As the switching ring and the switching handle is further prevented from rotating during the operation thereof under the drilling mode, it is possible to work drilling more stable without working the clutch mechanism fail to switch over to the clutch mode.

Yet preferably another switching plate having a tip formed therewith is further furnished, and the switching ring has another recessed portion defined therein for engagement with the another switching plate, and a distance between the longitudinal axis of the spindle and a position at which the tip of the switching plate engages in the recessed portion differs from a distance between the longitudinal axis of the spindle and a position at which the tip of the another switching plate engages in the another recessed portion. The switching handle can thus rotate an angle of about 360 degrees for switching over from the clutch mode to the drilling mode, making it possible to vary the working torque finely.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

This application is based on applications Nos. 2002-246719 and 2002-247820, both filed Aug. 27, 2002 in Japan, the respective contents of which are hereby incorporated by reference.

Now, description will be given below in detail of an embodiment of a vibrating drill/driver according to the present invention, referring to the accompanying drawings.

Figure 1:
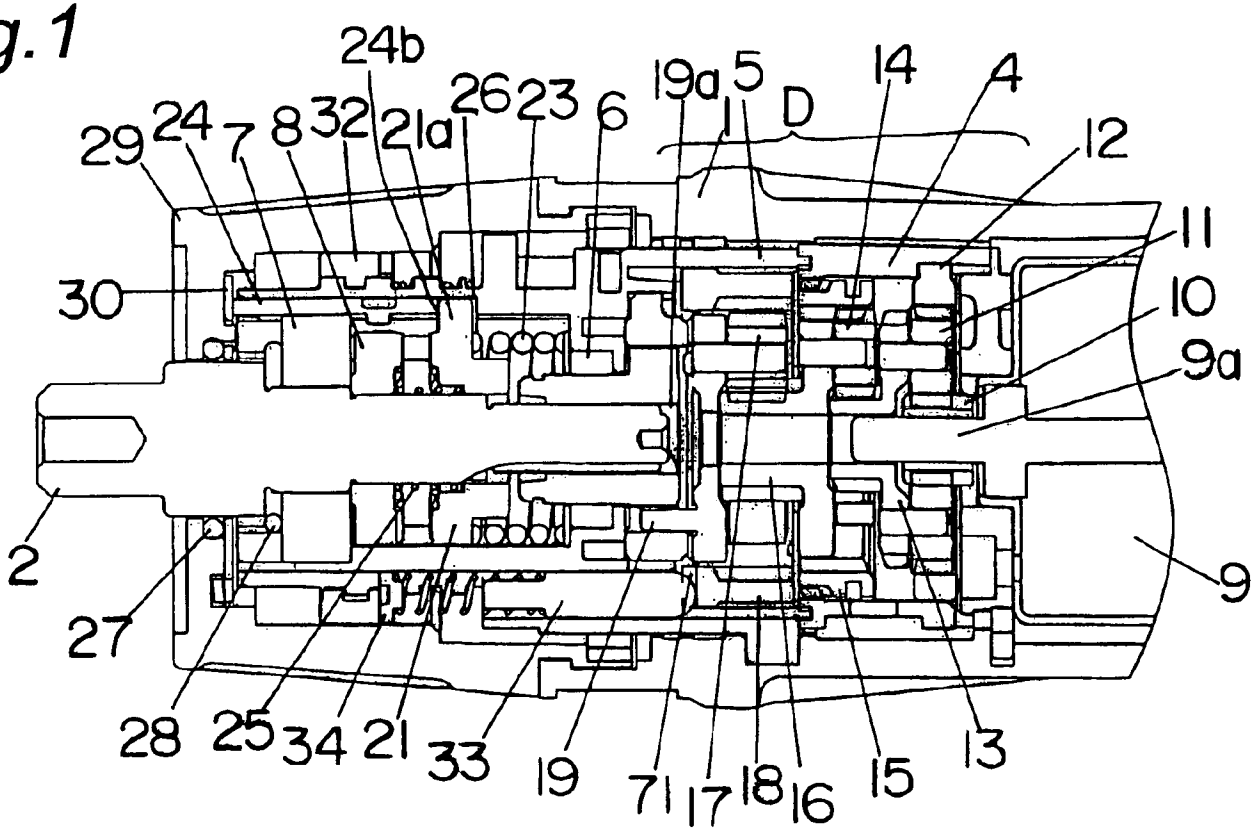
FIG. 1 is a cross sectional view of a principal portion in a clutch mode of a first embodiment of a vibrating drill/driver according to the present invention.

FIG. 1 shows a portion of a vibrating drill/driver set under a clutch mode. A free end of a spindle 2, which projects axially outwardly from a front end surface of a tool housing 1 that defines an outer shell of the vibrating drill/driver, is designed to receive a chuck (not illustrated) for replaceably supporting a bit which may be a drill bit or a screwdriver bit. The spindle 2 is supported by a gear box 4 and a casing 5, both disposed within the tool housing 1, through spindle bearings 6 and 7, so as to rotate freely about the longitudinal axis thereof and also as to slide freely in an axial direction thereof. For this purpose, a rear end portion of the spindle 2 is formed with a series of splines, for example, splined projections for connecting with a reduction unit D.

The reduction unit D includes three stage reduction mechanisms. The first stage reduction mechanism includes a sun gear 10 fixedly mounted to an output shaft 9*a* of a motor 9 housed within a rear section of the housing 1, a plurality of planetary gears 11 engaging the sun gear 10, a ring gear 12 engaging the planetary gears 11, and a carrier 13 supporting the planetary gears 11. The second stage reduction mechanism includes a plurality of planetary gears 14 engaging the carrier 13 as a sun gear, a ring gear 15 engaging the planetary gears 14, and a carrier 16 supporting the planetary gears 14. The third reduction mechanism includes a plurality of planetary gears 17 engaging the carrier 16 as a sun gear, a ring gear 18 engaging the planetary gears 17, and a carrier 19 supporting the planetary gears 17. Also, the carrier 19 is formed with splined grooves 19*a* for engagement with the splined projections on the spindle 2 so that the carrier 19 can move in an axial direction of the spindle 2. The ring gear 15 is slidable axially of the spindle 2 in response to a manual slide of a speed changer (not shown, but mounted externally on the housing 1) between a disabled position, in which the ring gear 15 is engaged with a gear box 4 to disable the spindle 2 from rotating, and a rotating position in which the ring gear 15 is engaged with the carrier 13 to enable the spindle 2 to rotate.

At the splined area of the spindle 2, a ring-shaped rotary cam 8 is press-fitted onto an intermediate portion of the spindle 2, and a ring-shaped slide cam 21 is loosely mounted on the spindle 2 at a position between the spindle bearing 6 and the rotary cam 8 in opposition to the rotary cam 8. A projecting portion 21*a*, projecting radially outwardly from a slide care 21, is engaged in an axially elongated groove 26, which is formed on an inside face of the casing 5 so as to extend longitudinally of the tool, to thereby prevent the slide cam 21 from rotating about the spindle 2. This slide cam 21 is normally biased toward the rotary cam 8 by a spring 23 disposed between the spindle bearing 6 and the slide cam 21. A switching plate 24 is disposed in the groove 26 so as to slide freely in an axial direction thereof, with a rear end 24*b* of the switching plate 24 held in contact with the projecting portion 21*a* of the slide cam 21, so that the forward movement of the slide cam 21 by the action of the spring 23 is restrained to a predetermined position and, at the same time, a spring 25 is interposed between the slide cam 21 and the rotary cam 8 to thereby keep the slide cam 21 and the rotary cam 8 apart from each other.

Figure 2:
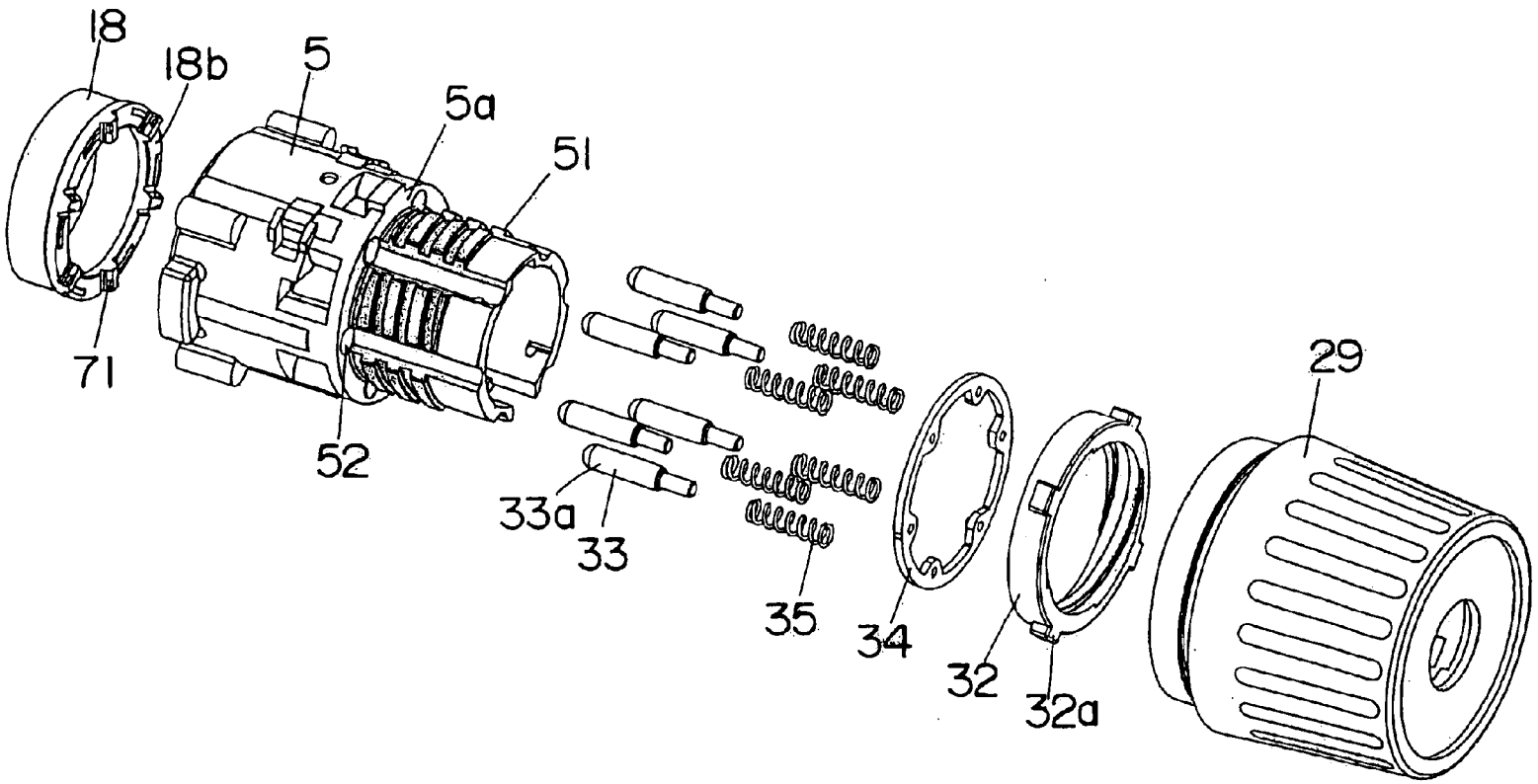
FIG. 2 is an exploded perspective view of the clutch mechanism.

As shown in FIG. 2, a helically threaded portion 51 is formed on an outer periphery of the casing 5 within the housing 1, and an internally threaded ring-shaped adjustment screw 32 is threadingly mounted on such threaded portion 51. Also, the adjustment screw 32 is formed with radially outwardly extending ribs 32*a*, which are engaged in mating recesses formed on an inner peripheral surface of about a generally cylinder-shaped switching handle 29. This switching handle 29 and the adjustment screw 32 can moves together in a direction axially of the casing 5. This switching handle 29 can rotate an angle of about 360 degree in one direction.

A clutch mechanism, which is operable to adjust the fastening torque of the spindle 2 and also to prevent a driving torque from being transmitted to a spindle 2 when the spindle 2 is applied a load torque larger than a predetermined torque, makes use of the ring gear 18, which is freely slidable in the third reduction mechanism of the reduction unit D, and is so structured as following.

As shown in FIG. 2, an axial end of the ring gear 18 is formed as a sliding surface 18*b* on which outwardly convex tips of pins 33*a* slide as an engaging body 33. The sliding surface 18*b* has circumferentially equidistantly spaced projecting portions 71 defined therein for engagement with the tips of the pins 33*a*. Also, a throughhole 52 is formed in a large diameter portion 5*a* of the casing 5 for each of the pins 33*a* so as to extend through the large diameter portion 5*a* in an axial direction thereof, and the pin 33*a* is disposed in the respective throughhole 52 so as to move freely therein. Although in the illustrated embodiment, each pin 33*a* having the outwardly convex tip is employed as the engaging body 33, a ball may be employed instead of the respective pin 33*a*. A clutch spring 35 is interposed between a shoulder of each pin 33*a* and a ring clutch plate 34. Those pins 33*a* are biased by the clutch springs 35 to slidably engage the sliding surface 18*b*.

In the clutch mechanism as described above, as the switching handle 29 is manually turned, the clutch plate 34 moves in the axial direction of the throughholes 52 through the cam so that the amount of compression of each clutch spring 35 can be so adjusted as to change the biasing force acting on the associated pins 33*a*. While the load torque applied to the spindle 2 is small, the tip of each pin 33*a* is engaged with the corresponding projecting portion 71 by the action of the associated clutch spring 35 to thereby prevent the ring gear 18 from rotating and, accordingly, driving power is transmitted to the spindle 2. On the other hand, when a load torque equal to or larger than a predetermined torque acts on the spindle 2, the pins 33*a* retract against the biasing force of the springs 35, overriding the projecting portions 71 and then onto the sliding surface 18*b* to thereby allow the ring gear 18 to rotate idle and, accordingly, no driving power is transmitted to the spindle 2. In this way, the clutch mechanism starts its operation when the spindle 2 receives the load torque equal to or larger than the predetermined value, but the clutch torque, which affects the operation of the clutch mechanism, is changeable to any desired torque in dependence on the load imposed on the clutch springs 35 that varies as the switching handle 29 is turned.

The structure as described above is interposed between the motor 9 and the spindle 2 to define the clutch mechanism of a kind wherein the working torque can be adjusted in dependence on the position of the switching handle 29.

Figure 3:
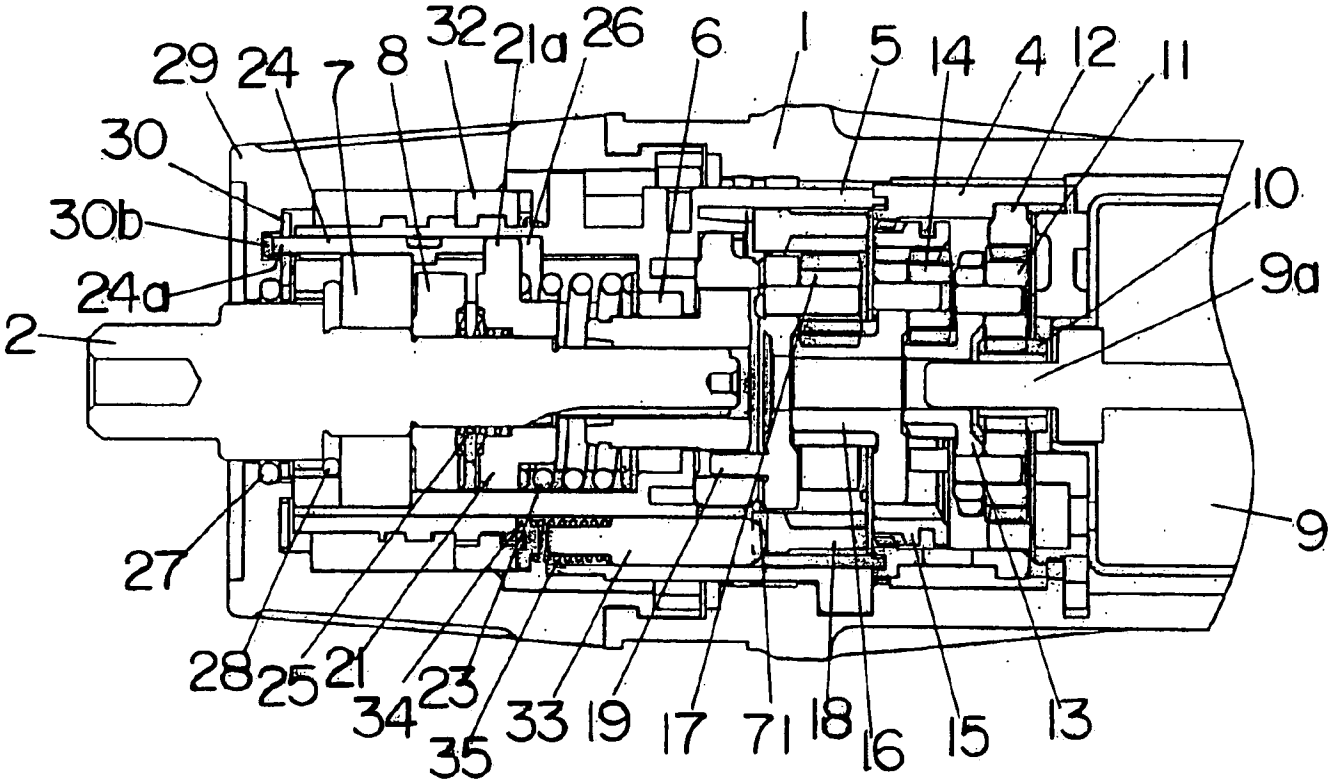
FIG. 3 is a cross sectional view of a principal portion in the vibrating mode of the embodiment.
Figure 4:
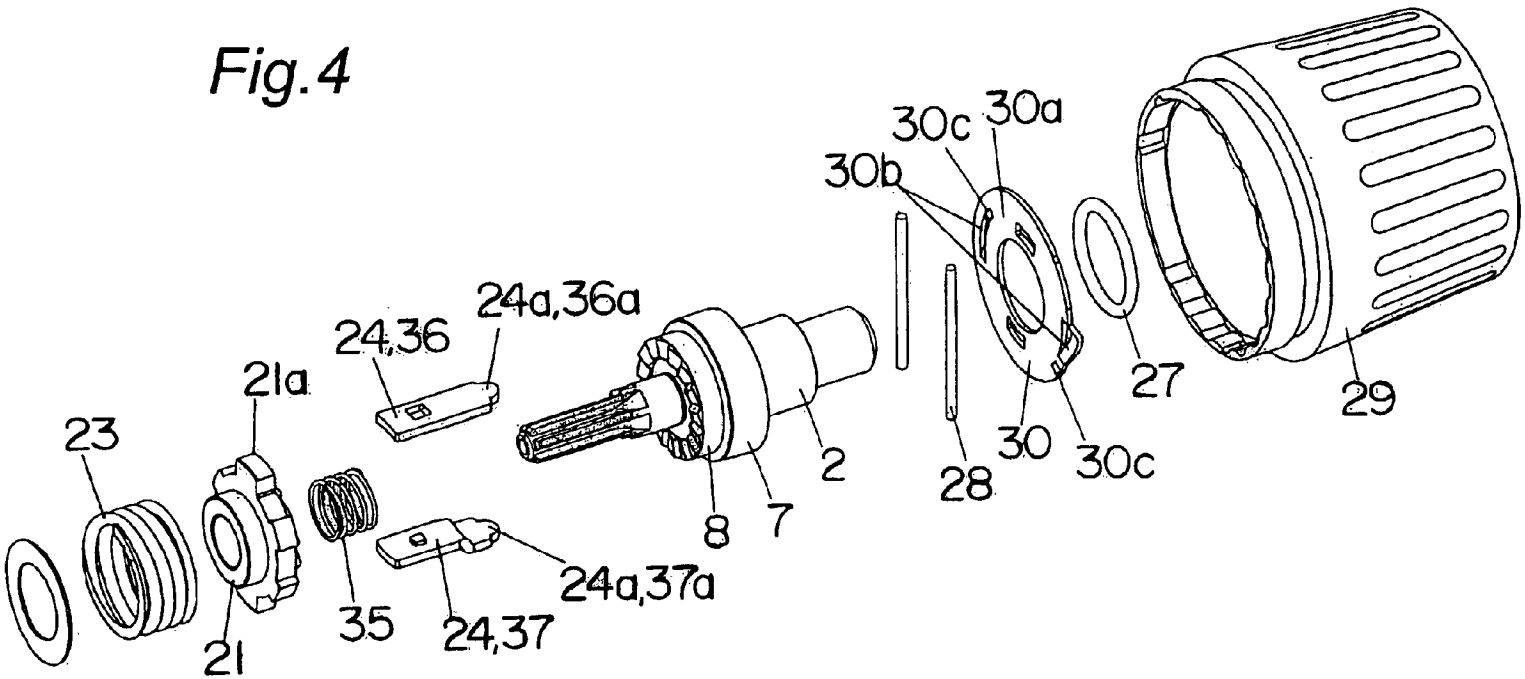
FIG. 4 is an exploded perspective view of the vibrating cam mechanism.

FIG. 3 shows the vibrating drill/driver set under the vibrating mode. As shown in FIG. 4, a switching ring 30 having a cam surface 30*a* defined in an axial end thereof is fixed on an inner surface of the switching handle 29 so as to rotate together with the switching handle 29, and a tip 24*a* of a switching plate 24 is inserted into and contacted with a recessed portion 30*b* in the cam surface 30*a* of the switching ring 30. Therefore, the switching ring 30 is engaged with the switching plate 24 with the recessed portion 30*b* receiving therein the tip 24*a* of the switching plate 24, to thereby avoid an accidental switching from the vibrating mode over to the clutch mode. An important portion of the switching ring 30 is shown in a sectional representation in FIG. 5.

Figure 6A:
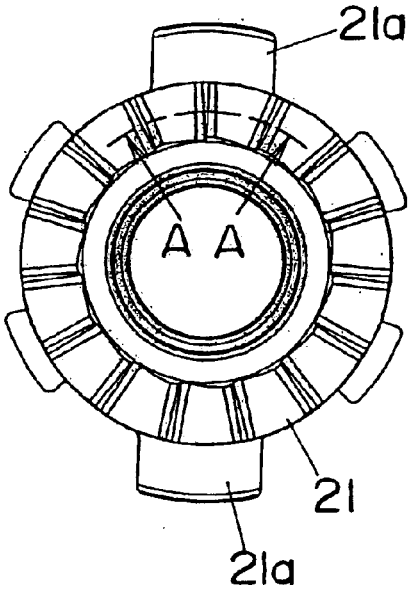
FIG. 6A is an elevation view of a cam surface of a slide cam constituting the vibrating cam mechanism.
Figure 6B:
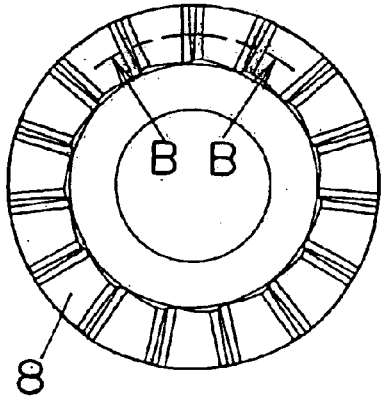
FIG. 6B is an elevation view of a cam surface of a rotary cam constituting the vibrating cam mechanism.
Figure 6C:
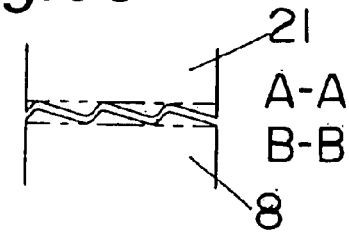
FIG. 6C shows a state of slidable engagement between a section taken on line A—A of FIG. 6A and a section taken on line B—B of FIG. 6B.

Respective surfaces of the rotary cam 8 shown in FIG. 6B and the slide cam 21 shown in FIG. 6A, which confront with each other, are so serrated in a complemental relation with each other that during the vibrating mode, the rotary cam 8 and the slide cam 21 are slidably engaged with each other as biased by the spring 23. Specifically, during the clutch mode, for example, the respective tips 24*a* of the switching plate 24 shown in FIG. 4 engage flat areas of the cam surface 30*a* other than the recessed portions 30*b* with the respective serrated surfaces of the rotary cam 8 and the slide cam 21 disengaged from each other. In contrast thereto, the vibrating mode, the tips 24*a* of the switching plates 24 are engaged in the recessed portions 30*b* of the switching ring 30 with the switching plates 24 consequently slide towards the rotary cam 8 and, on the other hand, the slide cam 21 is urged to a position approaching the rotary cam 8 by the action of the spring biasing force and, accordingly, the rotary cam 8 is brought into contact with the slide cam 21 in response to retraction of the spindle 2 under the influence of the load imposed thereon during the operation. It is to be noted that since while the rotary cam 8 can rotate together with the spindle 2, the slide cam 21 is unable to rotate due to the engagement thereof with the casing 5. Accordingly, as rotation of the rotary cam 8 while the serrated surface of the rotary cam 8 is engaged with the correspondingly serrated surface of the slide cam 21 results in the slide cam 21 being repeatedly pushed axially relative to the rotary cam 8. Thus, the rotary cam 8 undergoes a flapping motion relative to the slide cam 21 in a direction axially of the spindle 2, allowing the spindle 2 to be reciprocatingly moved back and forth. In this way, the spindle 2 is axially vibrated.

Switching of the vibrating drill/driver to the vibrating mode (that is, the mode in which the tips 24*a* of the switching plates 24 engaged in the recessed portions 30*b* of the switching ring 30) is accomplished when the switching handle 29 is turned a predetermined angular distance required to bring the pins 33*a* to a position near to, but slightly spaced from the clutch plate 34 and, in this condition, there is no possibility that the projecting portions 71 of the ring gear 18 may push the pin 33*a* to rotate and, accordingly, the working torque is of an infinite magnitude. Therefore, it is possible to rotate the spindle 2 while the latter is repeatedly vibrated in axial direction thereof.

Throughout the specification of this application, the phrase "infinite magnitude" means that a working torque from the motor 9 is directly transmitted to the spindle 2 through the reduction unit D.

It is to be noted that reference numeral 27 is a dust protection rubber and reference numeral 28 is a pin for restraining the stroke of axial movement of both of the rotary cam 8 and the spindle 2.

When the switching handle 29 is turned about 360 degrees to assume a finally rotated position (namely, when the switching handle 29 having been turned to a position corresponding to the vibrating mode from a position corresponding to the clutch mode is further turned past the position corresponding to the vibrating mode), the tips 24*a* of the switching plates 24 shown in FIG. 4 are disengaged from the recessed potions 30*b* of the switching ring 30 and ride over the projecting portions 30*c* on the cam surface 30*a* onto flat surface areas on one side of the projecting portions 30*c* opposite to the recessed portions 30*b* and, at the same time, the rear ends of the pins 33*a* shown in FIG. 2 are brought into contact with the clutch plate 34, with the switching handle 29 consequently brought to a stop. The slide cam 21 is then moved to a position where the switching ring 24 is retracted with the serrated surface thereof disengaged from the correspondingly serrated surface of the rotary cam 8. The working torque, at this time, is infinite magnitude due to the contact between the rear ends of the pins 33*a* and the clutch plate 34. In this condition, the drilling mode is established in which the spindle 2 rotates without being axially vibrated.

As described above, the vibrating drill/driver of the present invention can, depending on the position of the manually rotatable switching handle 29, set to one of the clutch mode, in which the working torque can be varied steplessly or in multistages except for infinite magnitude, the vibrating mode in which the spindle 2 is repeatedly vibrated, and the drilling mode in which the working torque is infinite magnitude, in this order specified above as the switching handle 28 is turned. Therefore, if the switching handle 29 unexpectedly rotate under the influence of an external force acting on the vibrating drill/driver during the operation thereof under the drilling mode, the vibrating drill/drive assumes the vibrating mode since at that time the tips 24*a* of the switching plate 24 are engaged in the associated recessed portions 30*b* of the switching ring 30, and will not thus be switched over to the clutch mode.

Figure 5:
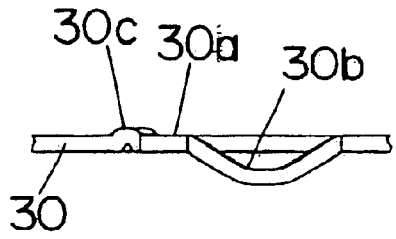
FIG. 5 is a cross sectional view of a principal portion of the switching ring.

As shown in FIG. 4 and FIG. 5, the projecting portion 30*c* is formed on the cam surface 30*a* of the switching ring 30 at a boundary portion between the place where the tip 24*a* of the respective switching plate 24 engages during the drilling mode and the place where the same engages, i.e., the corresponding recessed portion 30*b* during the vibrating mode and, accordingly, it is possible to inhibit an accidental switching from the drilling mode over to the vibrating mode and, hence, to prevent the clutch mechanism from working under the vibrating mode.

In this embodiment, each of the switching plate 24 and the recessed portion 30*b* engageable with the switching plate 24 is employed in two in number to ensure a stability in axial sliding motion of the slide cam 21 and in operation of the vibrating cam mechanism. However, if in such case the distance between the longitudinal axis of the spindle 2 and one of the switching plates 24 and the distance between the longitudinal axis of the spindle 2 and the other of the switching plates 24 are equal to each other, the maximum angle of rotation of the switching handle 29 available would be limited up to 180 degrees.

Figure 7A:
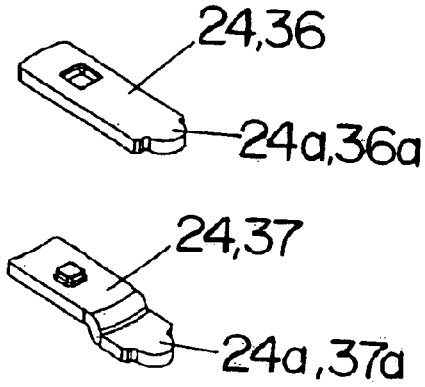
FIG. 7A is a perspective view of the switching plates.

In the embodiment as shown in FIG. 7A, the maximum angle of rotation of the switching handle 29 is further increased up to about 360 degrees. For this purpose, the switching plates 24 are constructed of a flat switching plate 36 and a stepped switching plate 37, respectively, so that the distance A between the tip 36*a* of the flat switching plate 36 and the longitudinal axis c of the spindle 2 and the distance B between the tip 37*a* of the stepped switching plate 37 and the longitudinal axis c are different from each other. Similarly, the recessed portion 40 defined in the switching ring 30 for engagement with the tip 36*a* of the switching plate 36 is formed at a position spaced a distance A from the longitudinal axis c of the spindle 2, and the recessed portion 41 defined in the switching ring 30 for engagement with the tip 37*a* of the switching plate 37 is formed at a position spaced a distance B from the longitudinal axis c of the spindle 2.

As described above, the selection of the different distances from the longitudinal axis of the spindle 2 to the position at which the switching plate 36 engages the corresponding recessed portion 40 and to the position at which the switching plate 37 engages the corresponding recessed portion 41, respectively, makes it possible for the switching handle 29 to be turned about 360 degrees from the position corresponding to the clutch mode to the position corresponding to the drilling mode. Accordingly, it is possible for the working torque during the clutch mode to be varied more finely.

Figure 7B:
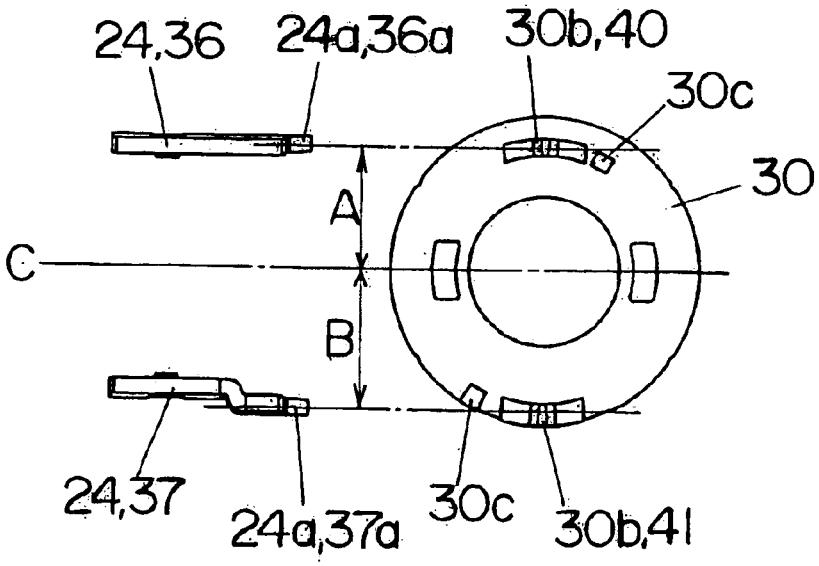
FIG. 7B shows a positional relationship between the switching plates shown in FIG. 7A and the switching ring shown in FIG. 5.
Figure 8A:
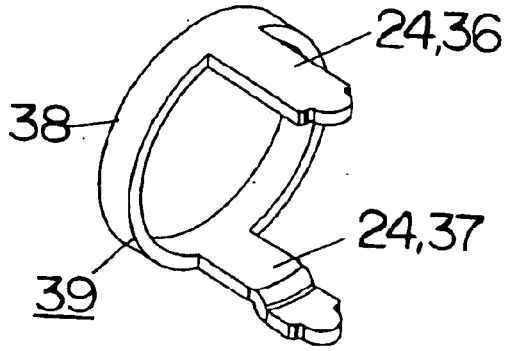
FIG. 8A is a perspective view of another example of the switching plates.
Figure 8B:
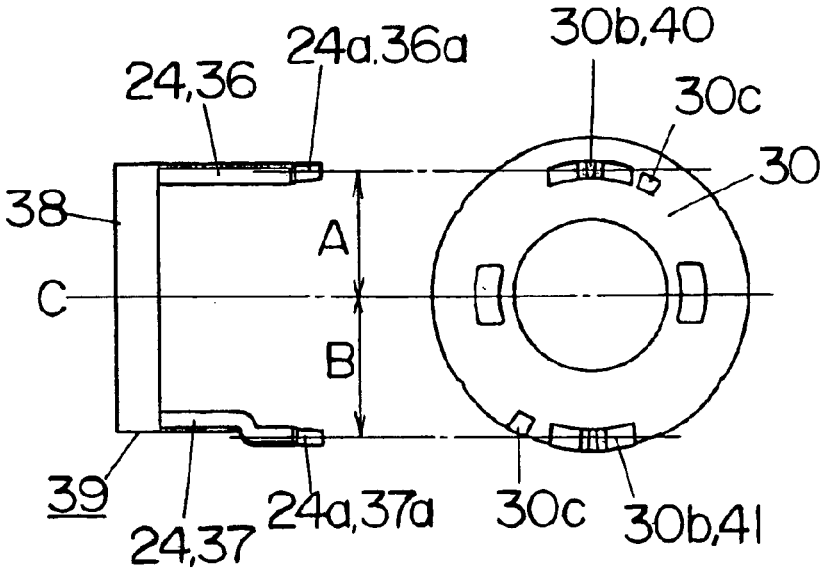
FIG. 8B shows a positional relationship between the switching plates shown in FIG. 8A and the switching ring shown in FIG. 5.

Also, as shown in FIG. 8A, the respective rear ends of the switching plates 36 and 37 may be connected together by means of a cylinder portion 38 to provide a unitary switching member 39, in which case similar effects to those afforded by the arrangement shown in FIG. 7B can be obtained as shown in FIG. 8B.

Figure 9A:
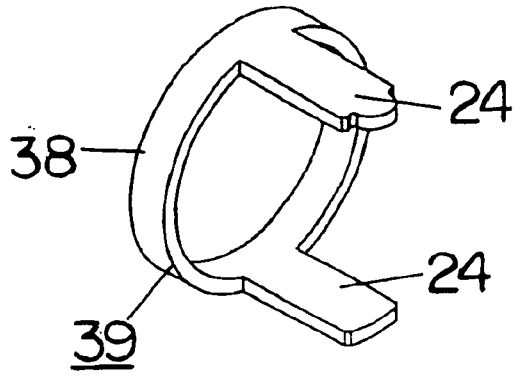
FIG. 9A is a perspective view of still another example of the switching plates.
Figure 9B:
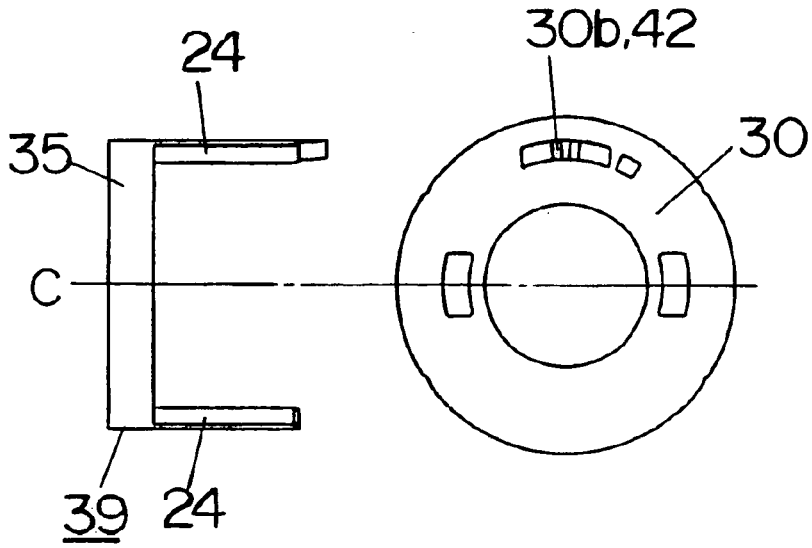
FIG. 9B shows a positional relationship between the switching plates shown in FIG. 9A and another example of the switching ring.

Yet, as shown in FIG. 9B, the switching ring 30 may have defined therein only one recessed portion 42 corresponding in function to one of the recessed portions 30*b* and, at the same time, as shown in FIG. 9A, the switching plates 24 may have respective lengths different from each other so that only one of the switching plates 24 can engage in the recessed portion 42 of the switching ring 30. In such case, effects similar to those afforded by the arrangement shown in and described with reference to FIGS. 7A and 7B can be obtained without utilizing the different distances from the longitudinal axis c of the spindle 2 to the respective tips 24*a* of the switching plates 24.

It is to be noted that effects similar to those afforded by the arrangement shown in and described with reference to FIGS. 7A to 9B can also be obtained not only where the switching plates 24 are positioned on respective sides with respect to the longitudinal axis c of the spindle 2, but also where three or more switching plates 24 are employed.

Figure 10A:
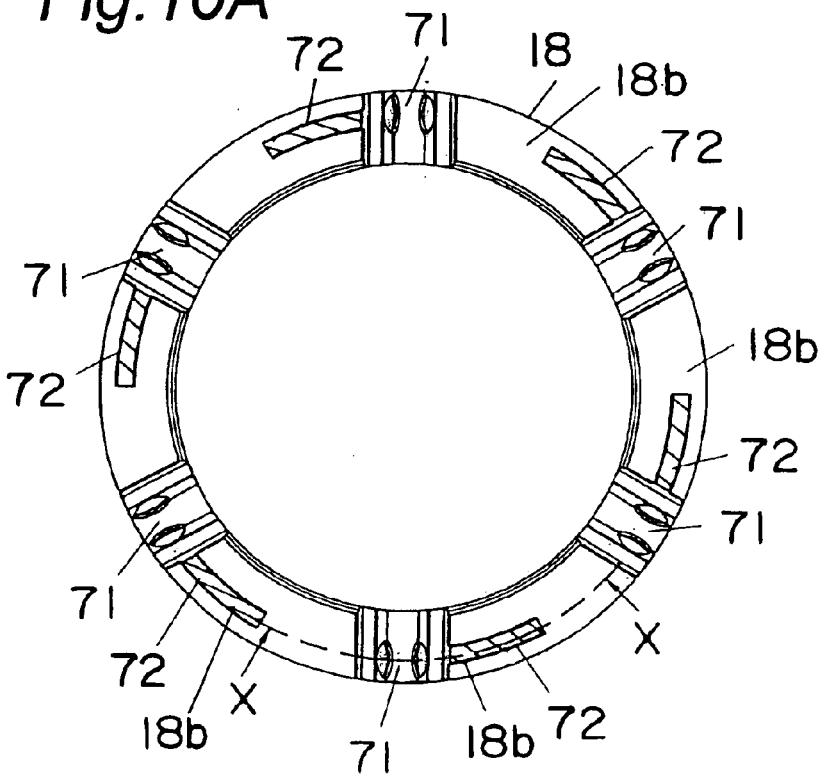
FIG. 10A is an elevation view of the ring gear.
Figure 10B:
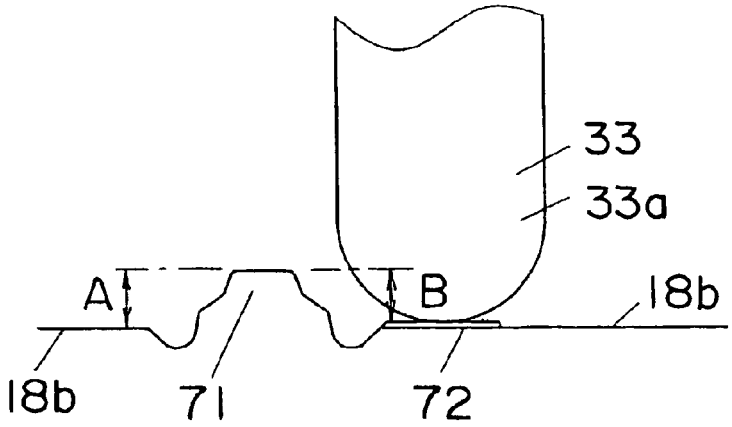
FIG. 10B is an expanded sectional view taken on line X—X of FIG. 10A.

The ring gear 18 shown in an exploded perspective view in FIG. 2 includes, as best shown in FIGS. 10A and 10B, a projecting portion 72, which has a height between the sliding surface 18*b* of the ring gear 18 and the projecting portion 71, so that a downstream portion of the sliding surface 18*b* onto which the respective pin 33*a* comes after having slid over the projecting portion 71 may be held at a level higher than an upstream portion of the sliding surface 18*b* from which each pin 33*a* slides over the projecting portion 71 during the rotation of the ring gear 18 relative to the respective pin 33*a*. The projecting portion 72 is formed by coining so as to be slightly raised outwardly from the level of the sliding surface 18*b* and also so as to extend a predetermined distance from the position where the respective pin 33*a* having slid over the projecting portion 71 touches down. During this coining process, the projecting portion 71 is also treated to have an increased hardness in other words, as shown in FIG. 10B the height A from the level of that upstream portion of the sliding surface 18*b* to the level of the top of the projecting portion 71 is so chosen as to be greater than the height B from the level of that downstream portion of the sliding surface 18*b* to the level of the top of the projecting portion 71. This relationship of A>B is effective in that as compared with the relationship of A=B, the impact generated upon touch-down onto the sliding surface 18*b* of the respective pin 33*a* having slid over the projecting portion 71 can be relieved to thereby minimize frictional wear of the pin 33*a* and the sliding surface 18*b*, which in turn results in prolongation of the lifetime of the clutch mechanism.

Figure 11A:
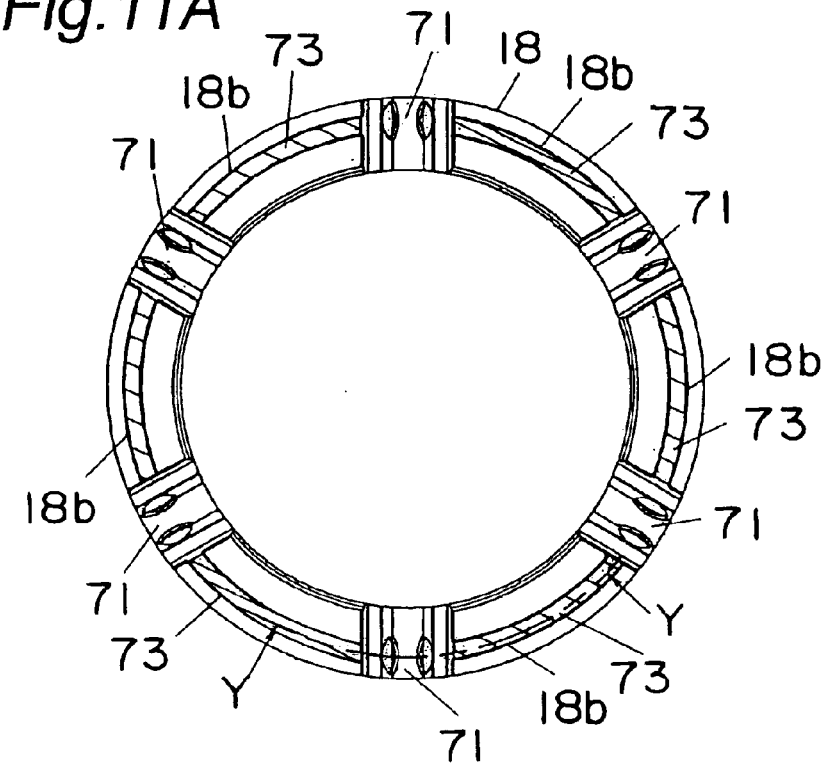
FIG. 11A is an elevation view of another example of the ring gear.
Figure 11B:
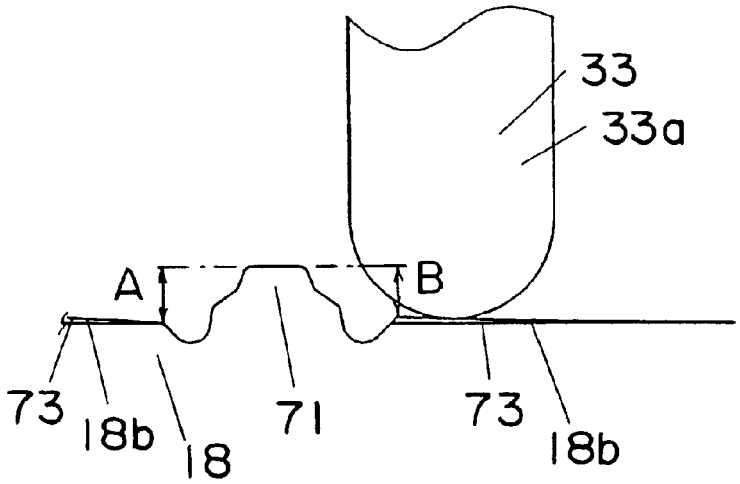
FIG. 11B is an expanded sectional view taken on line Y—Y of FIG. 11A.
Figure 14A:
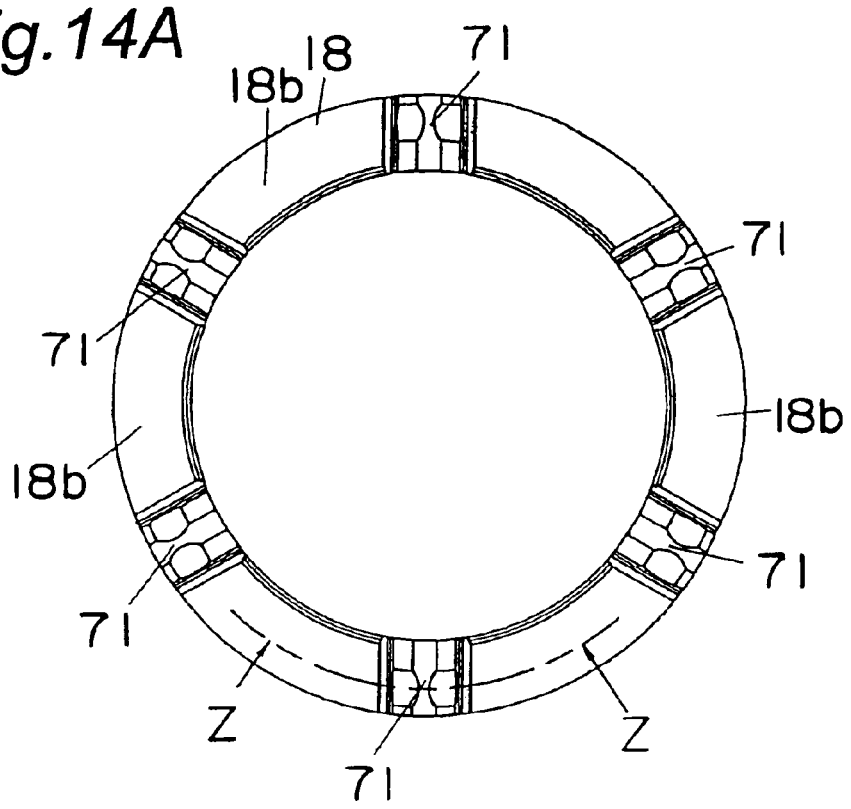
FIG. 14A is an elevation view of the ring gear according to a prior art.
Figure 14B:
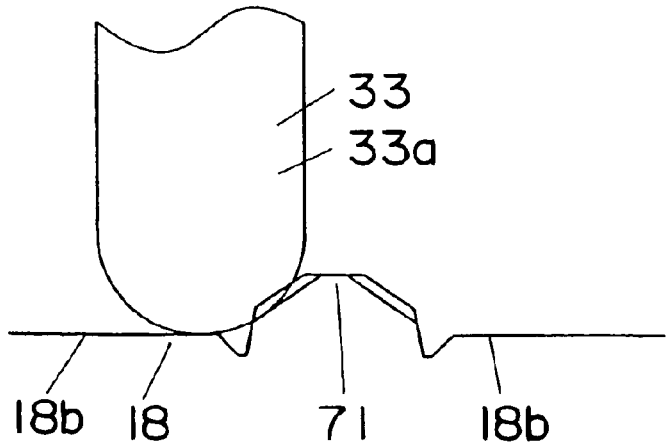
FIG. 14B is a sectional view taken on line Z—Z of FIG. 14A.

Also, in a modification shown in FIGS. 11A and 11B, a sloped projection 73 is formed on each of the upstream and downstream portions of the sliding surface 18*b*. That is to say, the sloped projection 73, which provides a gentle slope, is formed on the sliding surface 18*b* on respective sides of the respective projecting portion 71. As best showed in FIG. 11B, a portion of the sloped projection 73 on that upstream portion of the sliding surface 18*b* closest to the projecting portion 71 is held at a level lower than that of a portion of the sloped projection 73 on that downstream portion of the sliding surface 18*b* closest to the projecting portion 71, to thereby establish the relationship of A>B. Even in this case in view of the relationship of A>B, the impact generated upon touch-down onto the sliding surface 18*b* of the respective pin 33*a* having slid over the projecting portion 71 can be relieved to thereby minimize frictional wear of the pin 33*a* and the sliding surface 18*b*, which in turn results in prolongation of the lifetime of the clutch mechanism. Also, in this modification, in spite of the difference in level employed between the upstream and downstream portions of the sliding surface 18*b*, the rounded end of the respective pin 33*a* can smoothly slide along the sloped projections 73 and, accordingly, the frictional wear of the rounded end of the respective pin 33*a* and/or the sliding surface 18*b* can be minimized to increase the lifetime of the crack mechanism In the prior art shown in FIG. 14A and FIG. 14B the point contact takes place between the tip of the pin 33*a* functioning as a stop element 33 and the projecting portion 71 of the ring gear 18 until the pin 33*a* rides onto the top of the projecting portion 71 and, accordingly, the projecting portion 71 is susceptible to frictional wear due to a small area of contact between the pin 33*a* and the projecting portion 71. In view of this, and in the present invention, the following structure may be employed so as to minimize the frictional wear of the projecting portion 71 that would result from collision between the pin 33*a* and the projecting portion 71.

Figure 12:
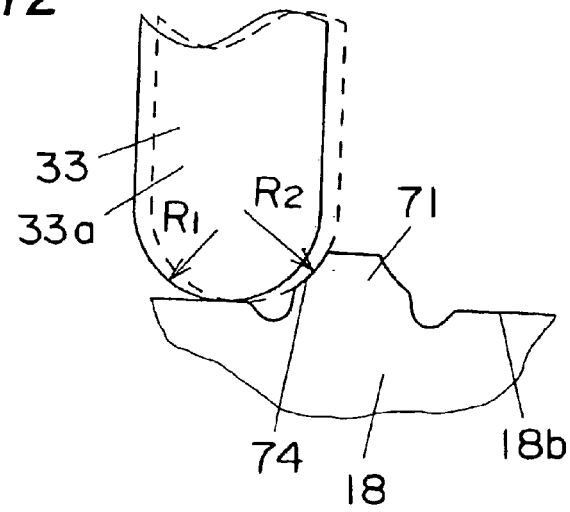
FIG. 12 is an expanded sectional view of principal portion of still another example of the ring gear.

In the example shown in FIG. 12, a portion of the projecting portion 71 where the rounded tip of the respective pin 33*a* ready to ride over the projecting portion 71 contacts is inwardly curved to define a concave portion 74 having a radius of curvature R2 substantially equal to the radius of curvature R1 of the rounded tip of the respective pin 33*a*, namely, R1=R2. Therefore, as the tip of the pin 33*a* contacts linearly the concave portion 74 at the time the pin 33*a* is ready to ride over the projecting portion 71, the surface area of contact of the pin 33*a* with the projecting portion 71 increases enough to effectively minimize the frictional wear, resulting in prolongation of the lifetime of the clutch mechanism.

Figure 13:
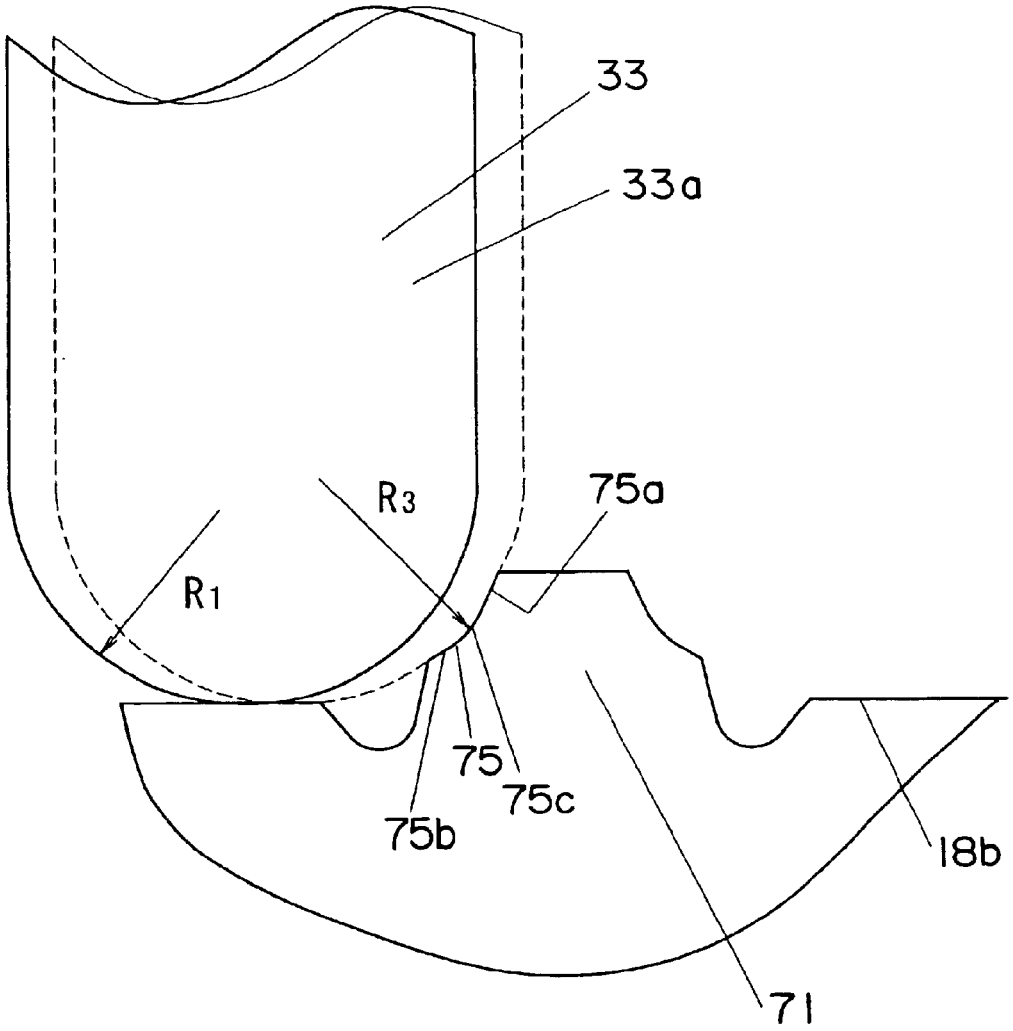
FIG. 13 is an expanded sectional view of principal portion of yet another example of the ring gear.

In an alternative example shown in FIG. 13, that portion of the projecting portion 71 where the rounded tip of the respective pin 33*a* ready to ride over the projecting portion 71 contacts is inwardly angled to have a generally obtuse-angled stair portion 75 delimited by a generally upwardly inclined surface 75*a* and a generally downwardly inclined surface 75*b*, which surfaces 75*a* and 75*b* form respective parts of an envelope 75*c* with the radius of curvature R1 of the rounded tip of the pin 33*a* being substantially equal to the radius of curvature R3 of the envelope 75*c*. In this alternative example, the line or multi-point contact takes place between the tip of the pin 33*a* and the projecting portion 71 of the ring gear 18 when the pin 33*a* is ready to ride onto the top of the projecting portion 71 with the surface area of contact of the pin 33*a* with the projecting portion 71 increased enough to effectively minimize the frictional wear, resulting in prolongation of the lifetime of the clutch mechanism.

It is to be noted that even in the examples shown in FIG. 12 and FIG. 13, respectively, the upstream and downstream portions of the sliding surface 18*b* may have respective projections of different heights such as shown and described with reference to FIGS. 10A to 11B, although not specifically described.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A vibrating drill/driver comprising:

a tool housing;

a spindle disposed within said tool housing movable in an axial direction thereof and also rotatable about a longitudinal axis thereof;

a motor disposed within said tool housing for driving said spindle about the longitudinal axis thereof;

a switching handle supported by said tool housing for rotation about a longitudinal axis thereof;

a clutch mechanism interposed between said motor and said spindle for adjustably varying a working torque in dependence on rotation of said switching handle;

a switching ring having a recessed portion defined therein and capable of rotating together with said switching handle;

a switching plate having a tip for engagement in said recessed portion; and a vibrating cam mechanism operable to undergo a slidable engagement to provide a vibration for repeatedly driving the spindle in an axial direction thereof when said tip of said switching plate is engaged in said recessed portion of said switching ring, wherein the rotation of said switching handle in one direction causes the vibrating drill/driver to be set in one of a clutch mode in which a working torque can be varied, a vibrating mode in which the spindle is provided with a vibration in an axial direction thereof, and a drilling mode in which a working torque from said motor is directly transmitted to said spindle in this order.

2. The vibrating drill/driver as set forth in claim 1, wherein said switching ring has a projecting portion formed therewith between said recessed portion and a place where said tip of said switching plate engages in said recessed portion during said drilling mode.

3. The vibrating drill/driver as set forth in claim 1, further comprising another switching plate having a tip formed therewith, and wherein said switching ring has another recessed portion defined therein for engagement with said another switching plate, and wherein a distance between said longitudinal axis of said spindle and a position at which said tip of said switching plate engages in said recessed portion differs from a distance between said longitudinal axis of said spindle and a position at which said tip of said another switching plate engages in said another recessed portion.

* * * * *